US005230977A

United States Patent [19]

Ohta

[11] Patent Number: 5,230,977

[45] Date of Patent: Jul. 27, 1993

[54] DEVELOPER MATERIAL TONER CONTAINING INORGANIC OXIDE PARTICLE COATING

[75] Inventor: Mitsuru Ohta, Nagoya, Japan

[73] Assignee: Brother Kogyo Kabushiki Kaisha, Nagoya, Japan

[21] Appl. No.: 617,594

[22] Filed: Nov. 26, 1990

[30] Foreign Application Priority Data

Dec. 6, 1989 [JP] Japan ..... 1-318537

[51] Int. Cl.[5] ..... G03G 9/00

[52] U.S. Cl. ..... 430/106; 430/106.6; 430/109; 430/138; 428/404

[58] Field of Search ..... 430/106, 106.6, 109, 430/111, 138; 428/404

[56] References Cited

U.S. PATENT DOCUMENTS

| | | | |
|---|---|---|---|
| 3,682,680 | 8/1972 | Hayashi et al. | 503/225 |
| 4,501,809 | 2/1985 | Hiraishi et al. | 430/138 |
| 4,853,311 | 8/1989 | Tavernier et al. | 430/106.6 |
| 4,908,301 | 3/1990 | Grosso et al. | 430/45 |

*Primary Examiner*—Marion E. McCamish
*Assistant Examiner*—S. Rosasco
*Attorney, Agent, or Firm*—Oliff & Berridge

[57] ABSTRACT

A developer material toner comprising powdered developer material color-reactable with dye or dye precursor and powdered inorganic oxide covering the surface of the powdered developer material.

6 Claims, 1 Drawing Sheet

FIGURE
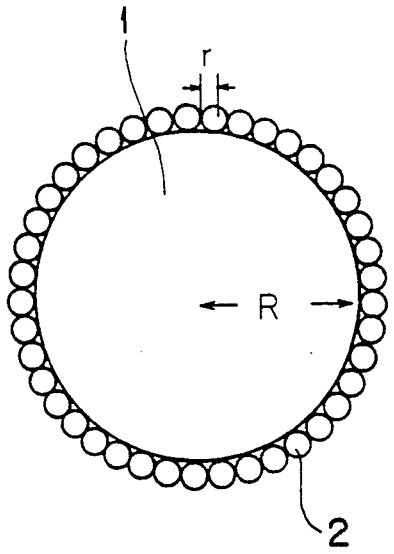

DEVELOPER MATERIAL TONER CONTAINING INORGANIC OXIDE PARTICLE COATING

BACKGROUND OF THE INVENTION

This invention relates to developer material toner, and more particularly to developer material toner capable of color-reacting with dye or dye precursor.

A developer sheet has been conventionally formed as a specific sheet by dispersing developer material in an aqueous solvent in an ultrafine particle form, adding binder and additives to the dispersed solution and then coating it on paper. An image forming technique using the developer sheet thus formed is disclosed in Japanese Unexamined Published Patent Applications No. 58-88739, No. 59-30537 and No. 59-137944.

The image forming technique as described above belongs to any type of technique in which two or more components separated from one another are contacted with one another due to a physical force such as pressure, temperature, etc. to react with one another, and then optical characteristics such as light-absorbing region, light-absorbing intensity, etc. of the components are changed to record information in accordance with the physical force. For example, there is an image forming technique utilizing a microcapsule sheet comprising a sheet coated with microcapsules having mechanical strength variable in accordance with light incident thereto and encapsulating colorless or slightly colored dye or dye precursor, and a developer sheet coated with developer material color-reactable with the dye or dye precursor encapsulated in the microcapsules. In this technique, when any kind of photosensitive recording medium coated with the microcapsules which has been exposed to light is superposed over the developer sheet under pressure to perform a pressure-developing process, some microcapsules are selectively ruptured due to a selective change in the mechanical strength to issue the colorless or slightly-colored dye or dye precursor from the ruptured microcapsules, and then the issued dye or dye precursor is color-reacted with developer material serving as a dye receptor coated on the developer sheet to form a visible image on the developer sheet.

In this type of technique, a visible image is formed only on a specifically manufactured sheet such as a developer sheet coated with a dye receptor (developer material). However, it has been frequently required in the art to form a visible image not only on the developer sheet, but also on any kind of medium such as a plain paper, post card or the like. In order to satisfy the above requirement, there has been proposed a developer material toner capable of color-reacting with microcapsules coated on a photosensitive and pressure-sensitive recording medium, which is powdered and then electrostatically coated on any kind of medium. However, it has been difficult to obtain an excellent developer material toner which is easily manufactured, has fluidity and sufficient pressure-fixability to any kind of medium such as plain paper, has stable fixing and developing properties for repetitive use, never adheres to a toner carrying member and a toner case and has a high stability during storage period (that is, can be stored with no aggregation and no caking).

In view of the above condition, it has been proposed to add the above developer material toner with a softening agent in order to improve the pressure fixability for any kind of medium. However, this type of developer material toner has various problems, for example, it is difficult to finely pulverize the developer material, and even if it is pulverized, powdered developer material toners easily adhere to the toner carrier and the toner case to cause aggregation and caking therebetween. On the other hand, it has been proposed to provide the above developer material toner with a rigid resin in order to easily carry out a powdering process and improve chargeability, fluidity and storing capability. However, the developer material toner thus obtained has remarkably degraded pressure fixability because the rigid resin is generally more rigid than the medium such as plain paper and thus it is not entangled in fibers constituting the medium even under pressure (that is, it is not fixed on the medium, but merely pressed against the surface of the medium). Accordingly, there has not been hitherto obtained powdered developer material which has excellent pressure fixability for any kind of medium and sufficient chargeability, fluidity and storing capability.

SUMMARY OF THE INVENTION

In order to overcome the above disadvantage of the conventional powdered developer material, an object of this invention is to provide developer material toner having excellent pressure-fixability to any kind of medium and sufficient storing capability without aggregation and caking.

Another object of this invention is to provide developer material toner which are homogeneously transferred and fixed to any kind of medium to completely and accurately form a visible image.

In order to attain the above objects, developer material toner according to this invention comprises powdered developer material color-reactable with dye or dye precursor and powdered inorganic oxide provided on the powdered developer material, for example, in such a manner as to cover the surface of the powdered developer material.

The powdered inorganic oxide comprises any material selected from the group consisting of $SiO_2$, $Al_2O_3$, $CaCo_3$, ZnO, $SnO_2$, $TiO_2$, clay, kaoline, and talc. Further, the powdered inorganic oxide has a particle diameter ranging from one-fifth to one-twentieth of an average particle diameter of said powdered developer material. Still further, the powdered inorganic oxide is preferably provided in one-particle layer to the surface of said powdered developer material.

BRIEF DESCRIPTION OF THE DRAWING

The FIGURE shows a developer material toner comprising a particle of developer material and particles of inorganic oxide which are homogeneously attached to the surface of the particle of the developer material in one layer.

DETAILED DESCRIPTION OF THE INVENTION

Preferred embodiments of this invention will be described hereunder.

Developer material toner according to this invention basically comprises powdered developer material color-reactable with dye or dye precursor, and powdered inorganic oxide provided on the surface of the powdered developer material. The developer material toner according to this invention is produced as follows. At least one kind of developer material component serving as a dye receptor is mixed with a softening material such as polyethylene wax or paraffin wax to improve pressure fixability. The mixture is then pulverized and classified to obtain powdered developer material. The powdered developer material thus obtained is mixed with powdered inorganic oxide to attach the powdered inorganic oxide to the surface of the powdered developer material. The particles of powdered inorganic oxide serve to prevent the particles of the powdered developer material from becoming aggregated.

As dye or dye precursor color-reactable with the developer material of this invention may be practically used crystal violet lactone, benzoyl leuco methylene blue, or other materials.

The developer material which serves as the as dye receptor preferably includes a natural clay mineral such as acid clay, bentonite, kaolinite, or apatalgite, or an organic acid such as tannic an acid, gallic acid, or an ester of propyl gallic acid, acid polymer such as phenol resin, a maleic acid resin, phenol-acetylene resin, or a condensation compound of carboxylic acid having at least one hydroxy group and formaldehyde, or metal salt of carboxylic acid such as zinc salicylate, tin salicylate, zinc 2-hydroxynaphthoate, zinc 3-5-di(tert-butyl)-salicylate, or zinc 3, 5-α-methylbenzyl salicylate, or a metal salt of phenol resin compounds obtained by denaturing the phenol resin compounds with a metal such as zinc, nickel or the like, or a mixture of the above materials.

As the inorganic oxide may be used $SiO_2$, $Al_2O_3$, $CaCo_3$, ZnO, $SnO_2$, $TiO_2$, clay, kaoline, talc or the like. The powdered developer material and the powdered inorganic oxide is mixed by a mixer until the particles of the powdered inorganic oxide are homogeneously attached to the surface of the powdered developer material, preferably in a one-particle layer as shown in the FIGURE. In The FIGURE, reference numerals 1 and 2 represent a particle of the developer material and a particle of the inorganic oxide, respectively. In order to satisfy the above conditions, the powdered developer material and the powdered inorganic oxide is preferably mixed in a specific mixing ratio to the extent that the surface area of a particle of the powdered developer material is substantially equal to a sum of the cross-sectional areas of particles coated over the surface of the particle of the powdered developer material. The cross-sectional area of each particle of inorganic oxide is calculated with a particle diameter on area-basis The particle diameter on area-basis is a particle diameter which is calculated with respect to a cross-sectional area of the particle. That is, assuming that the average radius of the particle of the developer material is represented by R and the radius of the particle of inorganic oxide on area-basis is represented by r, the relationship between R and r is defined as the following equation, where N is the number of inorganic oxide particles coated on the surface of a particle of the developer material:

$$\sum_{j=1}^{N} \pi r_j^2 = 4 \pi R^2$$

For example, 0.1 to 20 parts by weight of the inorganic oxide is preferable to 100 parts by weight of the developer material.

The powdered inorganic oxide preferably has a particle diameter ranging from one-fifth to one-twentieth of an average particle diameter of the powdered developer material. When the developer material toner has inorganic oxide particles having a particle diameter greater than one-fifth of the average particle diameter of the powdered developer material, a filling ratio of the powdered inorganic oxide relative to that of the powdered developer material is heightened, so that the fluidity of the developer material toner is reduced rather than improved. When the particle diameter of the powdered inorganic oxide is excessively small (that is, below one-twentieth of the average particle diameter of the powdered developer material, aggregation occurs between the particles of the inorganic oxide and only a small amount of the powdered inorganic oxide is attached to the surface of the particles of the developer material, with the result that the fluidity is not improved and the mixing between the powdered developer material and the powdered inorganic oxide is difficult.

In the case where the developer material comprising the above material is powdered and electrostatically coated on any kind of medium, fixability and chargeability inherent to the material disturbs the powdered developer material to be transferred to the medium. Accordingly, it is required to improve the fixability and chargeability of the developer material. In order to improve fixability and adhesiveness of the developer material toner to any kind of medium, a fixing promoting agent such as a wax or an adhesive may be mixed to the above material.

As the adhesive may be preferably used ethylene/vinyl acetate copolymer, polyvinyl ether, vinyl chloride/-vinyl acetate copolymer, polyvinyl chloride, polyacrylic ester, ethylene/ethyl acrylate copolymer, polyvinyl acetate, or polyvinylbutyral. Further, as the wax may be preferably used carnauba wax, candellila wax, rice wax, lanolin wax, jojoba wax, Japan wax, beeswax, paraffin wax, microcrystalline wax, montan wax, halogenated paraffin wax, castor wax, slack wax, sasol wax, amide wax or ozokerite, or polyolefines such as polyethylene or polypropylene. These adhesives and waxes may be used alone or in combination to the extent that a property inherent to the developer material is not lost.

In order to improve the chargeability of the developer material toner, a charge-control agent such as nigrosine dye or a metal-containing dye is preferably mixed with the developer material. Further, in order to maintain the fluidity and lubricity of the surface of the developer material toner and promote the pulverization, an aliphatic hydrocarbon, or higher aliphatic alcohol is preferably mixed to the developer material.

A mixture of the above-described materials are premixed and kneaded, and then pulverized by a pulverizer, to thereby form particles of the developer material toner. The developer material toner thus obtained has a broad particle diameter distribution, and thus electrostatic aggregation is liable to occur. Accordingly, the particles having a particle diameter below 5 microns are cut off through a classifying process. The developer material toner thus classified has a narrow particle diameter distribution The developer material is added with inorganic oxide and mixed by Henschle Mixer.

The particles of the developer material toner obtained through the above pulverizing, classifying and mixing processes are filled in a toner case of an electrostatic type of developing unit, and then the toner case is inserted into an image forming apparatus. The developer material toners are triboelectrically charged through friction and contact between the developer material toners or between the developer material toner and a toner carrying member such as a carry roller, and then electrically transferred from the toner carrier to any kind of toner supporting medium (for example, a plain piece of paper), so that the toner supporting medium is practically used as an image-forming medium. The medium coated with the developer material toner is superposed over a pressure-sensitive recording medium coated with microcapsules encapsulating dye precursor therein under pressure to thereby perform both operations for rupturing the microcapsules to issue the dye precursor encapsulated in the ruptured microcapsules and color the dye precursor through a color reaction between the dye precursor and the developer material, and for pressure fixing the developer material toner to the medium.

EXAMPLE 1

A mixture of 100 parts by weight of p-phenyl phenol, 40 parts of p-t-butyl phenol, 20 parts of polyethylene wax, 10 parts of ethylene/vinyl acetate copolymer and 2 parts of charge control agent is pulverized by the Henschle Mixer to produce a powdered mixture having a particle diameter below 2 mm. The powdered mixture thus obtained is melted and kneaded at 100° C. and 1 kg/hr with a biaxial extruder, and then cooled and solidified at room temperature to form a lump of resin mixture. The lamp of resin mixture is roughly pulverized with a rough pulverizer and finely pulverized with an air flow type of jet mill. The pulverized mixture has particles having diameters ranging from several microns to several hundreds of microns, and thus is classified by an air flow type of classifier to obtain developer material toner particles having diameters from 5 to 20 microns and having the particle-diameter distribution as described above. Thereafter, 100 parts by weight of the developer material tone thus obtained is added to 5 parts of $SiO_2$ fine powder and a mixing process is carried out by the Henschle Mixer for 10 minutes to thereby obtain developer material toner comprising the developer material particles and the $SiO_2$ particles homogeneously attached to the surface of the developer material particles.

The developer material toner thus obtained is filled in an electrostatical coating/developing device, and electrostatically coated onto plain paper. Thereafter, the plain paper coated with the developer material toner is superposed over a photoseneitive and pressure-sensitive recording medium under pressure-by-pressure rollers to perform a color reaction between the dye precursor and the developer material toner and to fix both of the colored dye precursor and developer material toner onto the plain paper. Through the transferring and developing processes of the developer material toner, no aggregation and caking is observed and the developer material toner is fixedly transferred to the plain paper. Further, a visible image is completely and accurately formed on the plain paper.

As described above, the developer material toners according to this invention have excellent fixability to any kind of medium, chargeability and storage capability because of the absence of aggregation and caking. Further, the developer material developer is homogeneously transferred and coated to the surface of any kind of medium, so that a pressure is uniformly supplied to the surface of the developer material layer through a pressure-developing process and a visible image formed on the medium is prevented from partially peeling off.

What is claimed is:

1. Developer material toner for use in an image forming apparatus, comprising:

powdered developer material color-reactable with dye or dye precursor to form a color image; and powdered inorganic oxide with a particle diameter ranging from one-fifth to one-twentieth of an average particle diameter of said powdered developer material provided on the surface of said powdered developer material.

2. The developer material toner as claimed in claim 1, wherein said powdered inorganic oxide comprises any material selected from the group consisting of $SiO_2$, $Al_2O_3$, $CaCo_3$, ZnO, $SnO_2$, $TiO_2$, clay, kaoline, and talc.

3. The developer material toner as claimed in claim 1, wherein said powdered developer material comprises any material selected from the group consisting of acid clay, bentonite, kaolinite, or apatalgite, tannic acid, gallic acid, ester of propyl gallic acid, phenol resin, maleic acid resin, phenol-acetylene resin, a condensation compound of carboxylic acid having at least one hydroxy group and formaldehyde, zinc salicylate, tin salicylate, zinc 2-hydroxynaphthoate, zinc 3-5-di(tert-butyl)salicylate, zinc 3, 5-α-methylbenzyl salicylate, metal salt of phenol resin compounds and a mixture thereof.

4. Developer material toner for use in an image forming apparatus, comprising:

powdered developer material color-reactable with dye or dye precursor to form a color image; and powdered inorganic oxide provided in a one-particle layer on the surface of said powdered developer material.

5. The developer material toner as claimed in claim 4, wherein said powdered inorganic oxide comprises any material selected from the group consisting of $SiO_2$, $Al_2O_3$, $CaCo_3$, ZnO, $SnO_2$, $TiO_2$, clay, kaoline and talc.

6. The developer material toner as claimed in claim 4, wherein said powdered developer material comprises any material selected from the group consisting of acid clay, bentonite, kaolinite, apatalgite, tannic acid, gallic acid, ester of propyl gallic acid, phenol resin, maleic acid resin, phenol-acetyline resin, a condensation compound of carboxylic acid having at least one hydroxy group and formaldehyde, zinc salicylate, tin salicylate, zinc 2-hydroxynaphthoate, zinc 3-5-di(tert-butyl)salicylate, zinc 3,5-α-methyl-benzyl salicylate, metal salts of phenol resin compounds and a mixture thereof.

* * * * *